US005533735A

United States Patent [19]

Denney

[11] Patent Number: 5,533,735

[45] Date of Patent: Jul. 9, 1996

[54] DUELING DISC GAME

[76] Inventor: Peter J. Denney, 552 Third St., Ann Arbor, Mich. 48103

[21] Appl. No.: 496,495

[22] Filed: Jun. 29, 1995

[51] Int. Cl.[6] ..... A63B 71/02

[52] U.S. Cl. ..... 273/411

[58] Field of Search ..... 273/411, 57.1

[56] References Cited

U.S. PATENT DOCUMENTS

| | | | |
|---|---|---|---|
| 2,822,176 | 2/1958 | Robes | 273/411 X |
| 3,226,118 | 12/1965 | Nehl | 273/57.1 |
| 3,366,386 | 1/1968 | Lindholm et al. | 273/411 X |
| 3,822,883 | 7/1974 | De Vos | 273/411 |
| 4,253,673 | 3/1981 | Bailey | 273/411 X |
| 4,497,492 | 2/1985 | Lehman, Jr. et al. | 273/411 |
| 4,880,243 | 11/1989 | Raub | 273/411 |

*Primary Examiner*—William H. Grieb
*Attorney, Agent, or Firm*—Young and Basile

[57] ABSTRACT

A game kit and method of playing a game using a spinning disc. The game kit includes boundary elements which are selectively arranged to form a throwing area, a target area, and a distance between the throwing area and the target area in variably selected sizes and distance spacing according to the players level of skill. A spinning disc is thrown by one player located in the throwing area toward a second player located in the target area who must catch the disc before the disc contacts the playing surface within the target area to prevent the throwing player from being awarded a point. The players alternate throwing and defending according to rules of play of the game.

13 Claims, 2 Drawing Sheets

DUELING DISC GAME

BACKGROUND OF THE INVENTION

1. Field of the Invention

The present invention relates, in general, to spinning discs and, more specifically, to games utilizing spinning discs.

2. Background Description

Numerous games involve one or more players throwing or hitting various projectiles past one or more other players into a net or boundary area or over a line defended by the other players. One popular game uses a spinning disc which, in a non-competitive activity, can be tossed and caught by two or more players. Such discs are used in competitive contests involving teams of one or more players where the object is to catch the disc thrown by the other player or team before it strikes the ground. Such discs have also been used in a target-type game wherein nets are spaced apart in a preset layout similar to a golf course. Two or more players traverse the layout from net to net with the object being to achieve the least number of tosses of the disc into each net over the entire layout.

While such games are enjoyed by numerous people, it would still be desirable to provide a toss-type game, particularly one involving a spinning disc, which combines conventional throw and toss game objectives with target/defend game features. It would also be desirable to provide such a game which is easy to set up and to play. It would also be desirable to provide such a game which can be easily adjusted in layout configuration to provide enjoyable and/or competitive play at different skill levels.

SUMMARY OF THE INVENTION

The present invention is an apparatus and method of playing a game utilizing a spinning, aerodynamic-shaped disc.

The inventive method comprises the steps of:

a) forming a throwing area;

b) forming a target area spaced a variably selectible distance from the throwing area;

c) forming the target area with a front boundary line having a variably selectible length between opposed ends, and a pair of spaced side lines, the side lines having an identical variably selectible length extending from opposite ends of the front boundary line;

d) the first player standing in the throwing area and hurling a projectile to land in the target area without being caught by the second player; and e) the second player standing in the target area and attempting to catch the projectile within the target area before the projectile lands within the confines of the target area formed by the front boundary line and the pair of side lines.

The step of forming the target area further comprises the optional step of forming a back boundary line spaced from the front line by a variably selectible length and extending between ends of the side lines.

The throwing area and the target area are formed by means of a kit which includes:

a) at least first and second groups of elongated, planar members, the members in the first group having a different length than the members in the second group; and b) means for removably attaching the members to a playing surface to form the throwing area, and to form the target area with at least a front boundary line spaced a variably selectible distance from the throwing area and a pair of side lines extending from opposite ends of the front boundary line.

One or several of the members of the first and second groups of members are arranged end-to-end and extend between the throwing area and the target area to space the throwing area from the target area by a distance equal to the length of the end-to-end arranged members.

Selected ones of the members of the first and second groups of members are interconnected end to end to form the front boundary line and the pair of side lines of the target area of variably selected lengths.

Selected ones of the members of the first and second groups of members may be connected end to end and spaced from the members forming the front boundary line and connected at opposite ends to one end of the members forming the side lines to form a back boundary line for the target area.

Preferably, the members of the second group of members have a length twice as long as the members of the first group of members. The first and second groups of members are preferably arranged to form a polygonal shaped throwing area and a polygonal shaped target area.

Apertures are formed at the ends of each of the members of the first and second group of members. Stake means are insertable through the apertures in the members and engagable with the playing surface to fixedly position the members on the playing surface.

The present game kit and method provide an enjoyable game utilizing a spinning disc which can be easily set up for play. Further, the game kit enables various boundaries of the game to be adjusted according to varying skill levels thereby enhancing the enjoyment and/or competition features of the game for players having different levels of skill.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
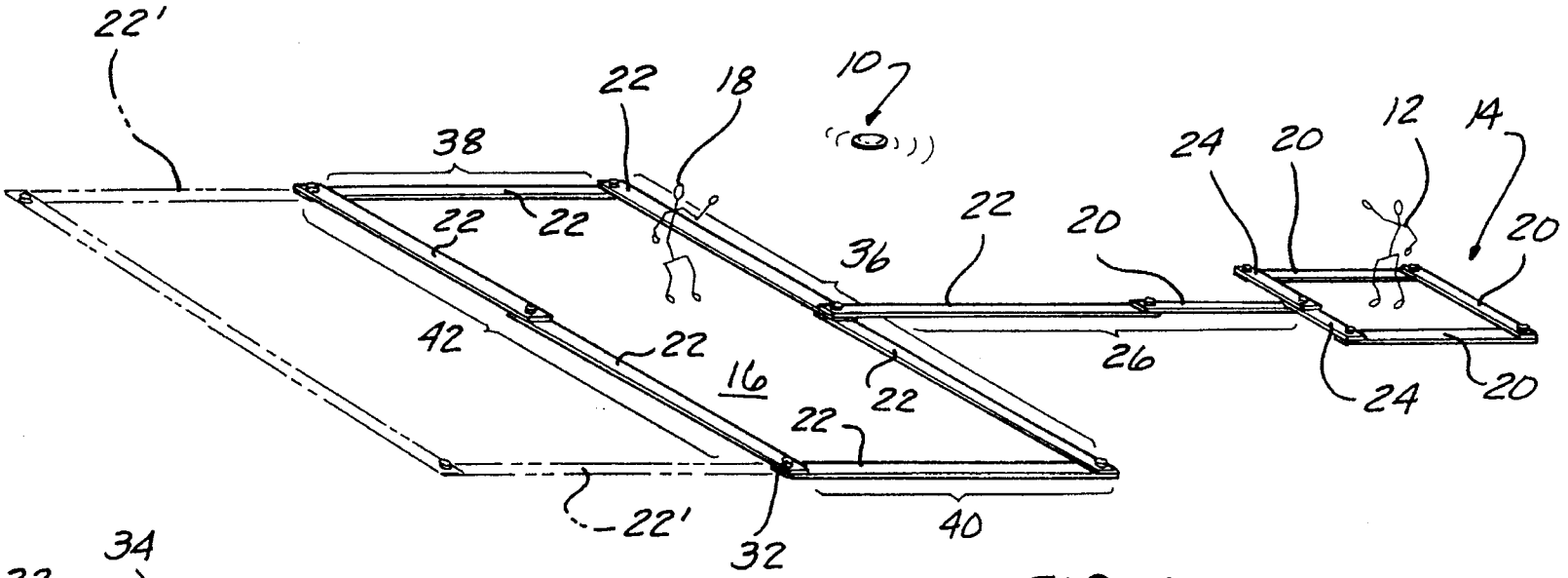
FIG. 1 is a perspective view showing the game kit of the present invention arranged in first and second skill level layouts.

Referring now to the drawing, and to FIG. 1 in particular, there is disposed one embodiment of the present invention which illustrates both the game apparatus and method of playing a spinning disc game.

In general, the game apparatus and the method of playing the game utilizes a spinning disc 10 which is thrown by a first player 12 located in a throwing area 14 toward a target area 16 which is defended by a second player 18. The kit apparatus includes a plurality of elongated planar members arranged in first and second groups. The members 20 in the first group have a different length than the members 22 of the second group. Preferably, the members 20 of the first group are half the length of the members 22 of the second group.

By way of example only, the members 20 in the first group of planar members have a length of approximately five yards, two inches; while the members 22 in the second group of elongated planar members have a length of approximately ten yards, two inches.

A front boundary for the throwing area 14 may be formed by two short length members 24 which form a third group of elongated planar members which have a length of approximately one half the length of the first members 20, such as 2.5 yards, two inches, by example only.

The planar members 20, 22 and 24 are preferably formed of thin, flat strips formed of a suitable material, such as plastic or cloth, which are arranged to form the boundaries of the throwing area 14, the target area 16, and a variable length spacing distance 26 between the throwing area 14 and the target area 18. The strips have a width of four inches, by example, to form a easily distinguishable boundary line.

Instead of flat plastic strips, the planar members 20, 22 and 24 may also be formed of other suitable materials, such as string, chains and even chalk boundary lines.

Figure 2:
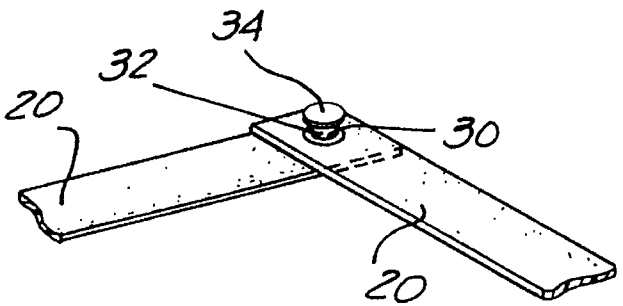
FIG. 2 is an enlarged, partial view showing the connection of the boundary members to an underlying playing surface.

Apertures formed by eyelets 30 are formed at opposite ends of each of the planar members 20, 22 and 24 as shown in detail in FIG. 2. As shown in FIGS. 1 and 2, the apertures formed by the eyelets 30 at overlapped ends of two members 20, as well as overlapped ends of members 20 and 22, are aligned and receive a suitable stake 32 or post which forms a stake means for removably attaching the planar members 20, 22 and 24 to an underlying playing surface, such as the ground. The stakes 32 are provided in a predetermined number in the present game kit and preferably have an elongated, pointed end which is insertable through two aligned eyelets 30 and into the underlying playing surface. The stakes 32 may be formed of any suitable material, such as plastic, with nylon being preferred, as well as metal, wood, etc. By way of example only, the stakes 32 are formed as elongated cylinders having a length of three inches and a ¾ inch diameter. An enlarged flat head of 1½ inch diameter, by example only, is formed on the upper end of each post 32 to aid in retaining the overlapped ends of the members 20, 22 and 24 together in the desired boundary configuration.

The stakes 32 and the boundary members 20, 22 and 24 of the game kit are provided in predetermined numbers to form multiple layouts and may be conveniently stored in a specially designed container, not shown, for easy transport.

FIG. 1 shows a first game layout in which the throwing area 14 has a polygonal shape, preferably a square shape. It will be understood that other polygonal configurations, such as rectangular, triangular, etc., as well as other shapes, such as circular, hemispherical, etc., may also be used to form the throwing area 14.

In a preferred embodiment, the throwing area 14 is formed of three first members 20 which are arranged in an overlapping, end-to-end, perpendicular configuration to form a square. Two short members 24 are overlapped end to end and interconnected between ends of two of the first members 20 to form a front boundary line for the throwing area 14 as shown in FIG. 1. The first offensive or throwing player 12 must remain at all times within the throwing area 14 defined by the interconnected members 20 and 24.

A spacing line 26 extends between the throwing area 14 and the target area 16. In a first embodiment for players of a first or beginning skill level, the spacing line 26 is by way of example only, fifteen yards in length. This length may be obtained by three end to end arranged first members 20 or one first member 20 connected end-to-end with one second member 22 as shown in FIG. 1. The outermost ends of the overlapped members 20 and 22 are interconnected by means of stakes 32 to the center of the front boundary line formed by the members 24 in the throwing area 14 and a front boundary line in the target area 16. Alternately, the short members 24 can be eliminated from the game kit and a first member 20 used to form the front boundary line of the throwing area 14. In this arrangement, one end of the end-to-end members 22, or 20 and 22 are fixed to the playing surface by a stake 32 immediately adjacent to the forward-most edge of the member 20 forming the front boundary line of the throwing area 14.

The target area 16 also has a polygonal configuration, which is rectangular by way of example only. The front boundary line 36 of the target area 16 is formed of two identical, end-to-end arranged second members 22 which combine to form an overall front boundary length denoted by reference number 36. Opposed side lines 38 and 40 of identical length extend from opposite ends of the front boundary line 36, generally perpendicular to the front boundary line 36. In the first skill level game layout, a back boundary line denoted by reference number 42 is formed by two overlapped, end-to-end arranged second members 22 which are interconnected by means of stakes 32 to opposite ends of each side line 38 and 40.

The dimensions of the first skill level game layout, as well as additional, higher skill level layouts are shown in the attached table.

| | throwing area - target area spacing distance 26 (yds) | target area front boundary 36 length (yds) | target area side lines 38, 40 length (yds) | target area back boundary 42 length (yds) |
|---|---|---|---|---|
| Beginner | 15 | 10/10 | 10 | 20 |
| Inter-mediate | 15 | 10/10 | 20 | 20 |
| Advanced | 20 | 15/15 | 20 | 30 |
| Pro | 20 | 15/15 | 30 or more | none |

The first row in the table shows the dimensions of the target area 16 and the spacing distance 26 as described above. The second row in the table for intermediate skill level players shows enlarged side line dimensions for the target area 16, shown in phantom in FIG. 1, which are formed by adding an additional second member to each side line 38 and 40 to increase the length of each side line 38 and 40 to the distance denoted in the table. In this second game layout, the back boundary 42 remains the same length as the front boundary 36 in the first skill level layout.

Figure 3:
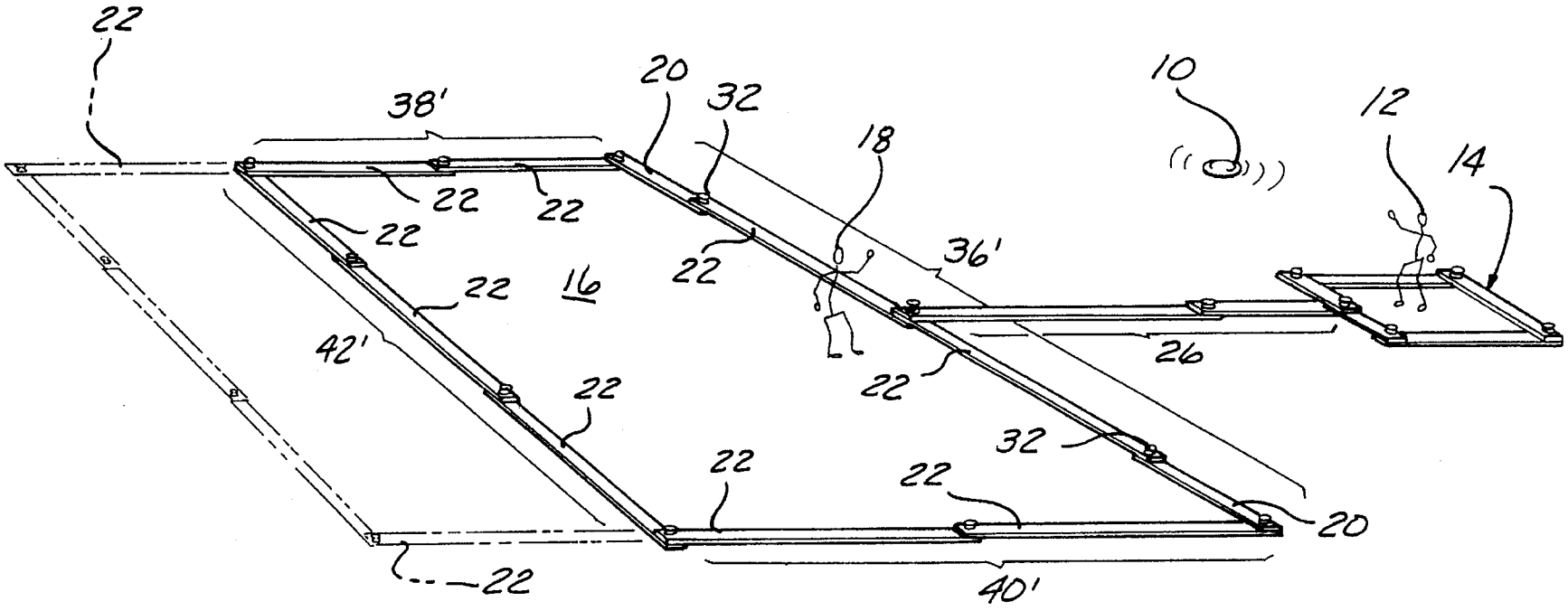
FIG. 3 is a perspective view showing the game kit of the present invention arranged in third and fourth skill level configurations.

FIG. 3 depicts third and fourth game layouts for advanced and professional skill level players. In the third embodiment denoted by the third row of the table, the front boundary 36' is increased in length from that shown in FIG. 1 and described above by adding an additional first member 20 to the outer end of each second member 22. The ends of each first member 20 and second member 22 are overlapped and interconnected by individual stakes 32 in the same manner as described above and shown in FIG. 2. The back boundary 42' is formed to the same length as the front boundary 36' by three overlapping end to end arranged second members 22. It should be noted that in this third game layout, the side lines 38' and 40' remain the same as the length of the side lines 38 and 40 in the second layout shown in the table and FIG. 1 in phantom.

The third game layout shown in FIG. 3 may also be modified to a fourth game layout as shown in the fourth row of the table by extending the length of each side line 38' and 40' by adding at least one additional second member 22 to one end of the second members 22 forming each side line 38' and 40'. Additional second members 22 may also be added to extend the length of each side line 38' and 40' to any desired length. The back boundary of the fourth game layout, as shown in the table, is open or non-existent. Optionally, a back boundary shown in phantom in FIG. 3 may be provided at the ends of the endmost second members 22 forming the side lines 38' and 40'.

Since the members 20 of the first group are half the length of the members 22 of the second group, two end-to-end arranged members 20 may be interchangeably used in place of one member 22 and vice versa to form any portion of a boundary line in any game layout.

In playing the game of the present invention, the object is for the offensive player 12 to hurl the projectile or disc 10 toward the target area 16 in an attempt to land the disc 10 on the playing surface within the confines of the target area 16 before the defensive player 18 catches the disc 10. At the same time, the objective of the defensive player 18 in the target area 16 is to catch the projectile 10, while remaining within the confines of the target area 16 before any part of the projectile 10 contacts the playing surface within the boundary of the target area 16.

By example only, the game of the present invention can be patterned after the game of baseball with a number of innings, such as nine. Three outs per inning are provided for each player who alternate as offensive and defensive players. A goal or point is obtained each time the offensive player 12 is successful in having a hurled disc 10 contact any part of the playing surface within the boundary of the target area 16 before the defensive player 18 catches the disc 10. An "out" is achieved each time the defensive player 18 catches the disc 10 while remaining within the confines of the boundary of the target area 16 at the time of catching the disc 10 or whenever the disc 10 thrown by the offensive player 12 does not land within the target area 16 and is not touched by the defensive player 18. A catch is still made by the defensive player 18 if he or she completes a catch of the disc 10 with both feet within the boundary of the target area 16 even though momentum may cause the defensive player to subsequently step out of the target area 16.

It should be noted that even if the defensive player 18 catches the disc 10, a point or goal is still scored if the disc 10 contacts the playing surface within the target area 16. A point or goal is also scored if the defensive player 18 contacts the disc 10 within the target area 16 without catching it, regardless of where the disc 10 lands inside or outside of the target area 16.

For enjoyment and/or speed of play of the game, certain other rules may be adopted. For example, the offensive player 12 must remain within the confines of the throwing area 14, without stepping on or beyond any of the boundary members 20 or 24 during each throwing attempt. The offensive player 16 must also face the defensive player 18 at all times during each throwing attempt. A certain time interval, such as ten seconds, may be imposed on the offensive player 12 during which the offensive player 12 must make a throw attempt. Further, at no time during the flight of the disc 10, can the disc 10 exceed a 45° angle from level in any direction. Other rules may also be adopted, similar to those used in baseball, to ensure fair play of the game.

In summary, there has been disclosed a unique spinning disc game kit or apparatus and method which provides an exciting and enjoyable game involving a spinning disc. The game kit is easy to set up and may be varied in configuration depending upon the level of skill of the players.

What is claimed is:

1. A method of playing a game between first and second players comprising the steps of:

forming a throwing area having a front boundary;

forming a target area with a front boundary line having a variably selectible length between opposed ends, and a pair of spaced side lines, the side lines having an identical variably selectible length extending from opposite ends of the front boundary line;

providing first and second groups of elongated, planar members, the members in the first group having a different length than the members in the second group;

providing means for removably attaching the first and second groups of members to a playing surface to form the throwing area and a target area;

attaching at least one of the members of the first and second groups of members at a first end to a central portion of the front boundary line of the throwing area and at a second end to a central portion of the front boundary line of the target area to space the throwing area from the target area;

attaching at least two members of the first and second groups of members to each extend oppositely from the second end of the at least one member extending between the throwing area and the target area, the at least two members forming the front boundary line of the target area;

attaching at least one member of the first and second groups of members to extend angularly from outer ends of each of the members forming the front boundary line of the target area to form the pair of side lines;

selectively attaching additional members of the first and second groups of members to at least one of the members extending between the throwing area and the target area, to the members forming the front boundary of the target area, and to the members forming the pair of side lines to vary at least one of the size of the target area and the spacing between the throwing area and the target area;

the first player standing in the throwing area and hurling a projectile to land in the target area without being caught by the second player; and the second player standing in the target area and attempting to catch the projectile within the target area before the projectile lands within the target area.

2. The method of claim 1 wherein the step of forming the target area further comprises the step of:

forming a back boundary line spaced from the front line by attaching at least one member of the first and second groups of members to one end of each of the pairs of side lines.

3. The method of claim 1 further comprising the step of:

forming the projectile of an aerodynamic disc.

4. The method of claim 1 wherein the step of forming the throwing area comprises the step of:

forming the throwing area in a polygonal shape.

5. The method of claim 1 wherein the step of forming the target area comprises the step of:

forming the target area in a polygonal shape.

6. The method of claim 1 further comprising the step of:

forming the members of the second group of members with a length twice as long as the length of the members of the first group of members.

7. The method of claim 1 further comprising the step of attaching a plurality of the members of at least one of the first and second groups of members to form the throwing area substantially smaller than the target area.

8. A kit for playing a game in which a first player standing in a throwing area hurls a projectile toward a spaced target area and a second player standing in the target area attempts to catch the projectile before the projectile lands within the target area, the kit comprising:

first and second groups of elongated, planar members, the members in the first group having a different length than the members in the second group; and means for removably attaching the members to a playing surface to form the throwing area, having a front boundary line to form the target area with at least a front boundary line and a pair of side lines extending from opposite ends of the front boundary line, and to form a line extending between the front boundary lines of the throwing area and target area to space the throwing area from the target area; and wherein at least one of the front boundary line of the target area, the pair of side lines of the target area and the line extending between the throwing area and the target is formed of selected ones of the members of the first and second groups of members to vary the size of the target area and the spacing between the throwing area and the target area.

9. The kit of claim 8 wherein:

selected ones of the members of the first and second groups of members are interconnected end to end to form the front boundary line and the pair of side lines of the target area in variably selected lengths.

10. The kit of claim 8 wherein:

selected ones of the members of the first and second groups of members are connected end to end and spaced from the members forming the front boundary line and connected at opposite ends to one end of the members forming the side lines to form a back boundary line for the target area.

11. The kit of claim 8 wherein:

the members of the second group of members have a length twice as long as the members of the first group of members.

12. The kit of claim 8 wherein the attaching means comprises:

apertures formed at ends of each of the members of the first and second groups of members; and stake means, insertable through the apertures in the members and engagable with the playing surface, to fixedly position the members to the playing surface.

13. The kit of claim 8 wherein:

the first and second groups of members are arranged to form a polygonal shaped throwing area and a polygonal shaped target area.

* * * * *